US006318011B1

(12) United States Patent
McCudden

(10) Patent No.: US 6,318,011 B1
(45) Date of Patent: Nov. 20, 2001

(54) SIGN ASSEMBLY

(75) Inventor: Arthur Lachlan McCudden, Wahroonga (AU)

(73) Assignee: Challangila Pty. Ltd. (AU)

( * ) Notice: Subject to any disclaimer, the term of this patent is extended or adjusted under 35 U.S.C. 154(b) by 0 days.

(21) Appl. No.: 09/399,433

(22) Filed: Sep. 20, 1999

(30) Foreign Application Priority Data

Sep. 18, 1998 (AU) ..... 86071/98

(51) Int. Cl.[7] ..... G09F 15/00
(52) U.S. Cl. ..... 40/606; 40/607
(58) Field of Search ..... 40/606, 607, 612; 248/158, 407, 910; 116/173; D20/19, 41

(56) References Cited

U.S. PATENT DOCUMENTS 1,466,465 * 8/1923 Belling ..... 40/607
3,559,322 * 2/1971 Nickel ..... 40/587
4,357,772 * 11/1982 Amick et al. ..... 40/606 X
4,759,545 * 7/1988 Grable ..... 248/910 X
5,048,779 * 9/1991 Wormser ..... 40/606 X
5,172,505 * 12/1992 Borsella ..... 40/606
5,502,910 * 4/1996 Lucchesi ..... 40/606
5,544,850 * 8/1996 Fankhauser ..... 40/606 X
5,833,199 * 11/1998 Benting et al. ..... 248/910 X

* cited by examiner

*Primary Examiner*—Brian K. Green
(74) *Attorney, Agent, or Firm*—Paul & Paul

(57) ABSTRACT

A sign board support structure comprises an upright, telescopically adjustable, tubular mast (7), a substantially horizontally extending cantilever projecting from the mast at or near the top thereof (9) and a bifurcated base (8) projecting rigidly and substantially horizontally from the bottom of the mast. The base is substantially symmetrical about a center line in the same vertical plane as the cantilever and has limbs (15) which diverge from each other with distance from the mast and are each adapted to be respectively wedged into the two cusp shaped spaces defined by a wheel tire (32) of a vehicle and the surface on which the vehicle stands. The base, mast and cantilever are united by demountable couplings (13,14).

12 Claims, 5 Drawing Sheets

SIGN ASSEMBLY

This invention relates to the operation of vehicle dealers'display yards, and in particular to the provision of advertising signage therein.

It is important, particularly where second hand vehicles are involved, for brief details, such as price, distance travelled, age and optional features possessed by each vehicle in the yard, to be made apparent to prospective customers. Typically this is achieved by painting on the vehicle windscreen or by displaying a sign board adjacent the vehicle, usually supported by a portable, free standing frame.

The first mentioned practice is undesirable as it renders the vehicle unsafe to drive and many customers want to test drive a vehicle before buying it. The second mentioned practice is undesirable because it is commercially important for vehicle dealers to display as many vehicles as possible in their yards, if only to reduce the yard rental cost per vehicle, and conventional free standing frames occupy aisle space between vehicles and so reduce the yard capacity.

Thus, there is a need for an advertising sign which may be temporarily and readily associated with a vehicle being offered for sale, which is preferably able to be read by a prospective customer facing the front of the vehicle, and which provides little or no obstruction either visually or physically to a person wishing to inspect the vehicle.

An object of the present invention is to fulfil that need.

The invention achieves that object by providing a sign board support structure which is inexpensive, which permits a sign to be suspended for display above a vehicle to which it relates, which occupies very little yard space around the vehicle, which has little impact on the visibility of, or accessibility to, the vehicle and which may be effectively stabilized against wind loads on the sign by the vehicle itself without damage thereto.

The invention consists in a sign board support structure comprising an upright mast, a substantially horizontally extending cantilever projecting from the mast at or near the top thereof and a bifurcated base projecting rigidly and substantially horizontally from the bottom of the mast, said base being substantially symmetrical about a center line in the same vertical plane as the cantilever and having limbs which diverge from each other with distance from the mast and are each adapted to be respectively wedged into the cusp shaped spaces defined by a wheel tire of a vehicle and the surface on which the vehicle stands on respectively opposite sides of the area of contact of the tire and that surface.

For preference, the mast, cantilever and base are separable components adapted to be readily assembled for use, and, subsequently, dissassembled for storage and transport. Also for preference the mast is telescopically adjustable in length to enable the support structure to be used with vehicles of differing heights or signs of differing sizes.

By way of example an embodiment of the above described invention is described more fully hereinafter with reference to the accompanying drawings.

Figure 1:
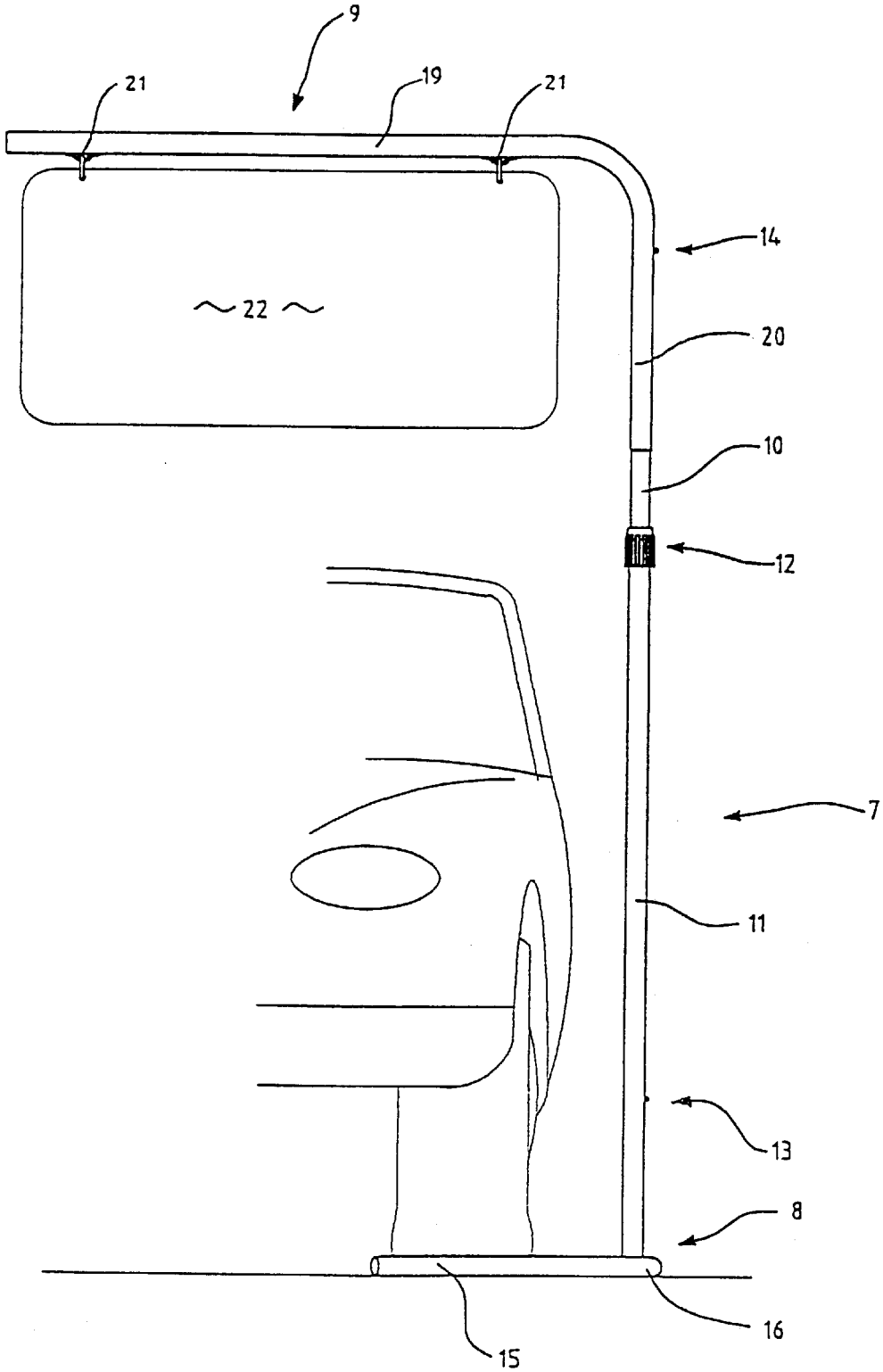
FIG. 1 is a front elevation of a support stand according to the invention shown in use supporting a sign board.
Figure 3:
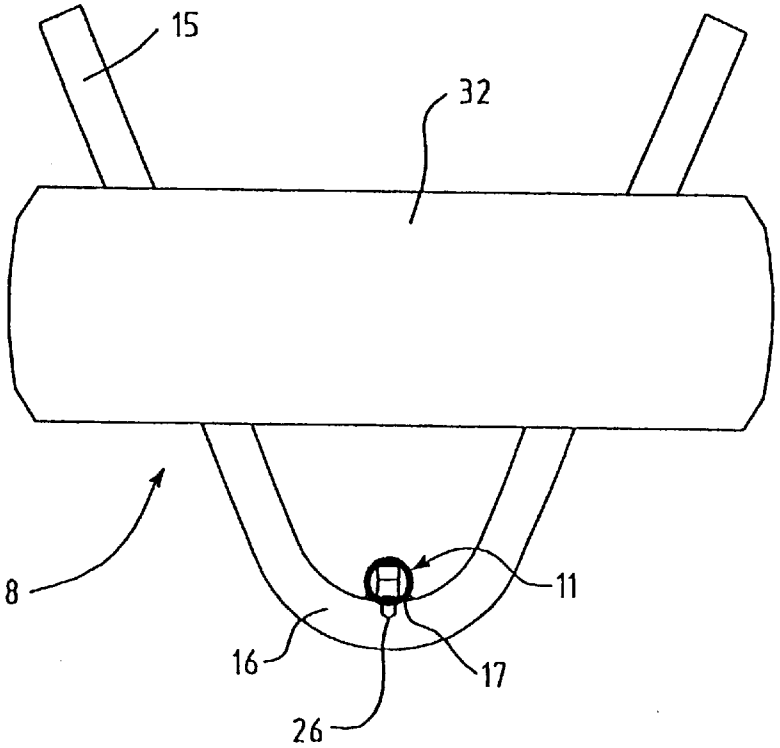
FIG. 3 is a plan view of the subject matter of FIG. 2.
Figure 2:
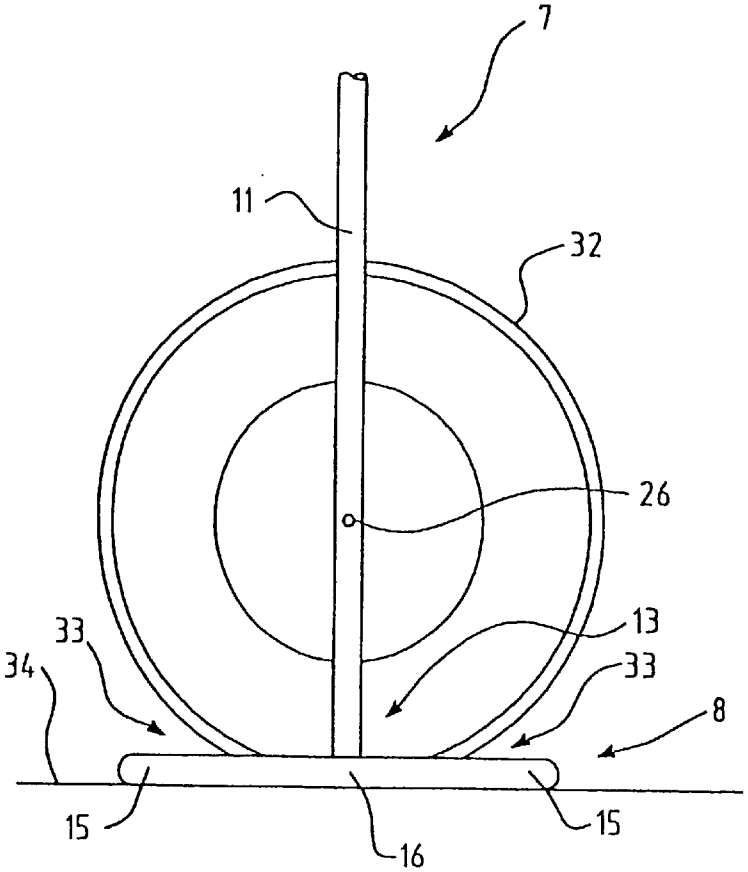
FIG. 2 is a side elevation of a bottom portion of the stand of FIG. 1 shown in use in association with a vehicle wheel.
Figure 4:
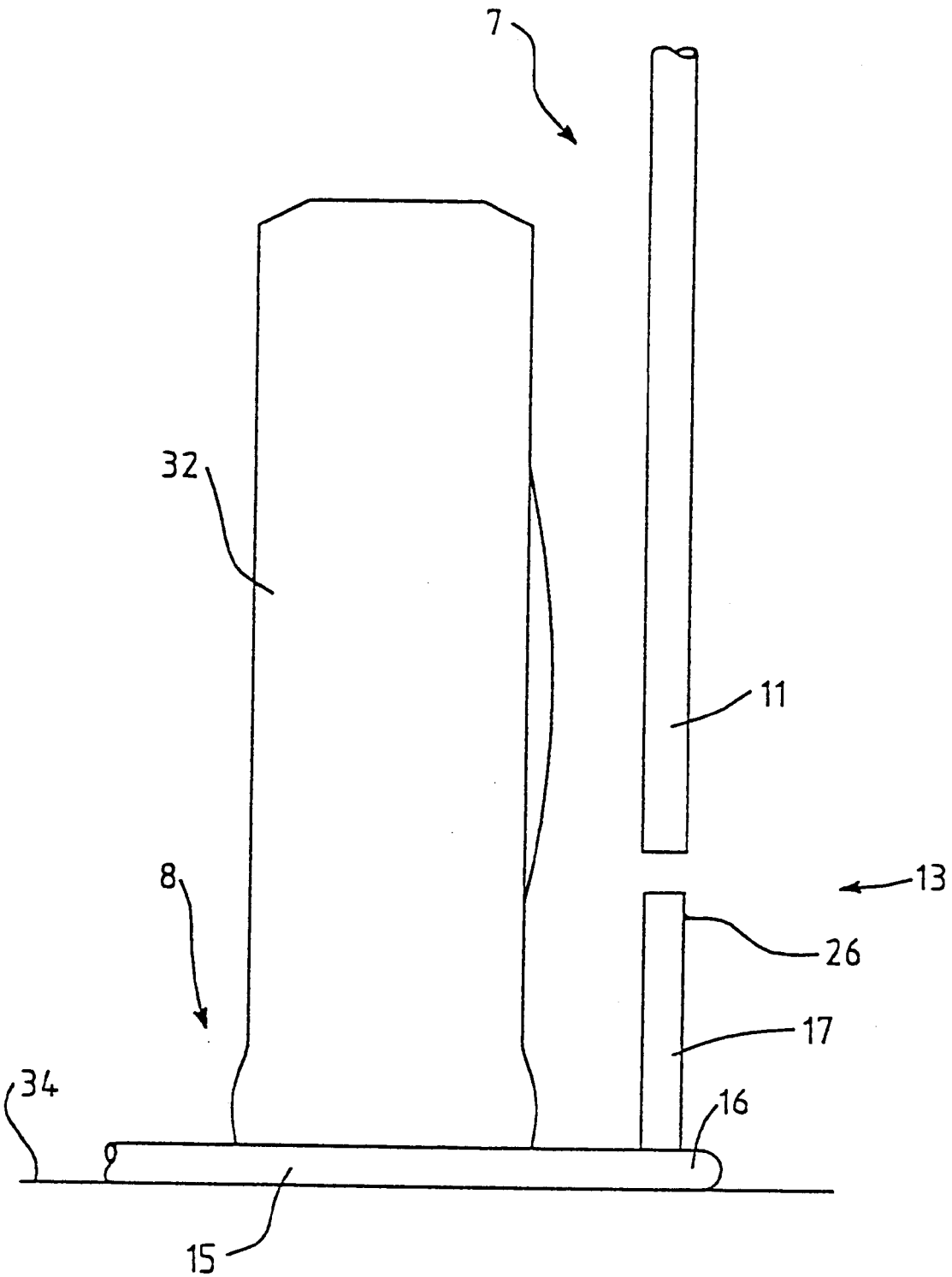
FIG. 4 is a front elevation of the subject matter of FIG. 2, with the mast and base thereof shown separated.
Figure 5:
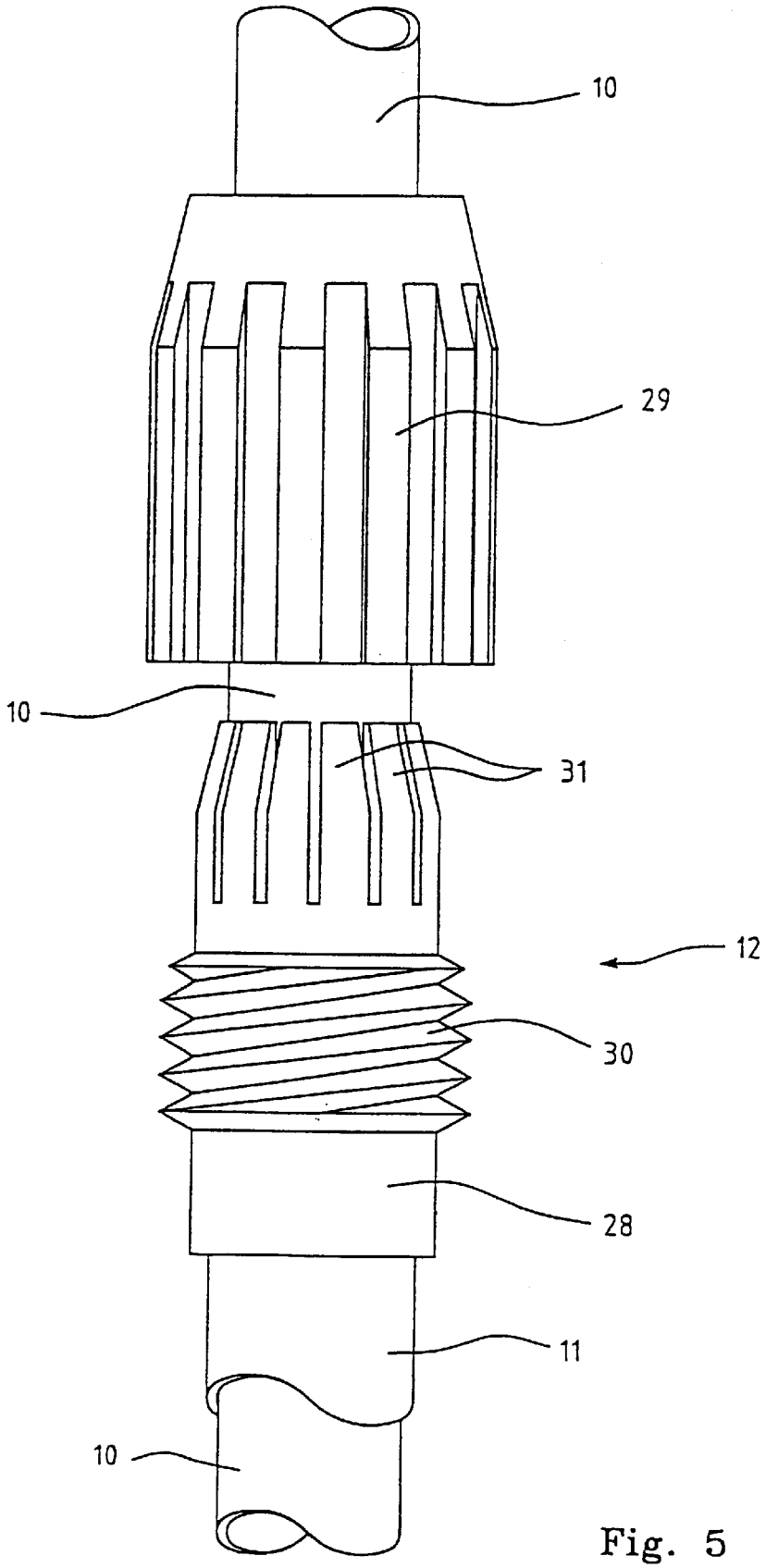
FIG. 5 is a front elevation of a telescopic coupling, being a component of the stand of FIG. 1 drawn to a larger scale.
Figure 7:
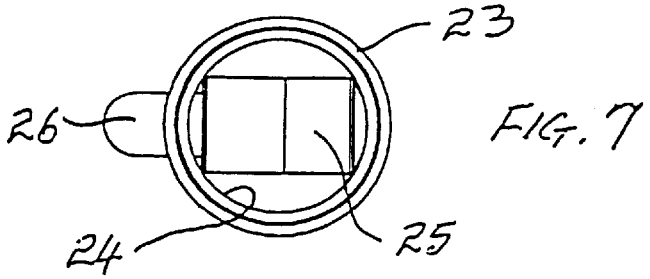
FIG. 7 is a plan view of the coupling of FIG. 6.

The illustrated embodiment of the invention comprises a tubular metal, telescopic mast 7, a tubular metal, bifurcated base 8 and a tubular metal cantilever 9. In other, simpler, embodiments those three components may be a one piece, integral structure fabricated from metal tube. In the present instance however the mast 7 is telescopic and comprises an inner tube 10, an outer tube 11 and a telescopic coupling 12, the base 8 is secured to the mast's outer tube 11 by a first demountable coupling 13, and the cantilever 9 is secured to the masts inner tube 10 by a second such coupling 14.

The base 8 comprises a U or V shaped metal tube with two limbs 15 diverging from a crotch portion 16, and a short, tubular, post stub 17 fixed to the crotch portion 16 and projecting substantially vertically upwardly when the base rests upon a horizontal surface. The stub 17 is a neat sliding fit within the mast's outer tube 11, preferably being of the same diametral dimensions as the mast's inner tube 10.

The cantilever 9 is an L shaped length of metal tube, preferably having inner and outer diameters the same as those of the mast's outer tube 11, and comprising a longer arm 19 and a shorter arm 20 with their axes defining an included angle of substantially ninety degrees.

The longer arm 19 of the cantilever 9 may be furnished with two eyes 21 to facilitate a sign board 22 being suspended therefrom by means of snap hooks or the like attached to the board. However, it should be emphasised that the nature of the sign and its mode of attachment to the cantilever may take any conventional forms and are not essential features of the present invention.

Figure 6:
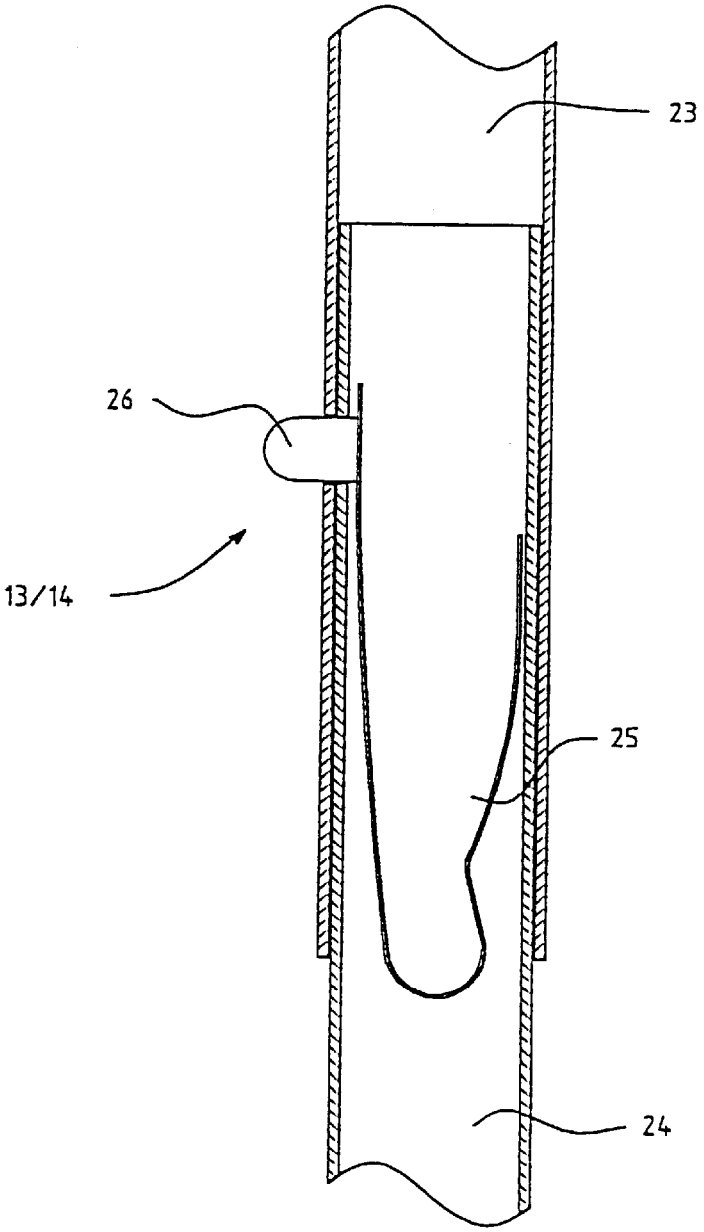
FIG. 6 is a longitudinal sectional view of a demountable coupling, being a component of the stand of FIG. 1 drawn to larger scale.

The demountable couplings 13 and 14 whereby the mast is assembled to the base and the cantilever respectively may be essentially identical and as shown in FIG. 6. Each comprises a larger diameter tube 23 (being the mast's outer tube 11 or the cantilever arm 20 as the case may be), a smaller diameter tube 24 (being the stub 17 or the mast's inner tube 10 as the case may be), and a resilient clip comprising a U shaped body 25, preferably formed from a strip of stainless spring steel, and a detainer boss 26. The detainer boss 26 may project through alignable clearance holes in the walls of both tubes 23 and 24. When the tubes 23 and 24 are to be coupled, the detainer boss 26 may be pushed inwardly by a thumb or finger to cause it to retract, the tube 24 may then be slid into the tube 23 until the boss clearance holes come into alignment. The pressure on the boss 26 may then be relaxed to allow it to enter the aligned clearance holes and so lock the tubes together. Disassembly is effected by reversing that sequence of operations.

For preference the mast 7 is telescopically adjustable by means of the telescopic coupling 12. It comprises a hollow cylindrical body 28 fixed to the outer tube 11 and a ring nut 29 sleeved upon the inner tube 10 and able to engage threads 30 on the body 28. The body 28 terminates at one end with a plurality of resilient fingers 31 each having a tapered end, and the bore of the ring nut 29 has a coacting taper at its end remote from the tube 11. The tube 10 may slide freely through the body 28 into the bore of the tube 11, but when the nut 29 is tightened upon the threads 30 the nut 29 presses the fingers 31 into pressure contact with the tube 10 thereby to frictionally retain the two tubes in any selected position of longitudinal adjustment therebetween.

In use, the telescopic coupling is adjusted having regard to the height of the vehicle and the size of the be displayed and the mast tubes rotated about there longitudinal axes to bring the cantilever arm 19 into substantially the same vertical plane as that including the axis of symmetry of the base 8, with the cantilever and the base projecting in the same direction from the mast. The structure may then be shifted bodily to bring the limbs of the base into firm engagement with a ground wheel tire 32 on opposite sides of its area of contact with the ground. The fact that the limbs of the base diverge enable them to contact any tire within a range of tire sizes. It will be apparent that the sign may thus be positioned above the vehicle to which it relates and the overturning moment on the structure imposed by the weight of the sign is resisted by pressure between the free ends of the base's limbs and the pressure contact between the tire and those limbs at points closer to the mast than those free ends. Furthermore it has been found that the wedging engagement of the base limbs with the ground and tire within the cusp shaped spaces 33 defined by the ground 34 and the tire effectively stabilize the structure against wind forces and the like acting on the sign without the need for any other affixing means.

What is claimed is:

1. A sign board support structure comprising an upright mast, a substantially horizontally extending cantilever projecting from the mast at or near the top thereof and a v-shaped bifurcated base projecting rigidly and substantially horizontally from the bottom of the mast, said base being substantially symmetrical about a center line in a same vertical plane as the cantilever and having limbs which diverge from each other with increased distance from the mast and are each adapted to be respectively wedged into cusp shaped spaces defined by a wheel tire of a vehicle and the surface on which the vehicle stands, on respectively opposite sides of the area of contact of the tire and the surface.

2. A support structure according to claim 1 wherein the length of the mast is telescopically adjustable.

3. A support structure according to claim 2 wherein at least one of the cantilever and the base is secured to the mast by a demountable coupling.

4. A support structure according to claim 1 wherein at least one of the cantilever and the base is secured to the mast by a demountable coupling.

5. A support structure for supporting a sign comprising an upright mast, support means for supporting a sign and a bifurcated base, said bifurcated base having limbs extending in a substantially horizontal direction, said limbs having a juncture located at or adjacent a lower end of said mast, said limbs diverging from said juncture such that a space is defined between respective free ends of the limbs whereby said base can be placed next to a vehicle wheel and moved to thereby position said limbs into cusp-shaped spaces defined by said vehicle wheel and a surface on which said vehicle wheel stands, respective ones of said limbs being on opposite sides of an area of contact of said vehicle wheel and said surface, wherein the support means comprises a substantially horizontally extending cantilever extending from or near a top of the mast.

6. A support structure as claimed in claim 5 wherein said limbs define an essentially v-shape.

7. A support structure as claimed in claim 5 wherein the mast is of adjustable length.

8. A support structure as claimed in claim 5, wherein said limbs define an essentially u-shape.

9. A sign board support structure comprising an upright mast, a substantially horizontally extending cantilever projecting from the mast at or near the top thereof and a u-shaped bifurcated base projecting rigidly and substantially horizontally from the bottom of the mast, said base being substantially symmetrical about a center line in a same vertical plane as the cantilever and having limbs which diverge from each other with increased distance from the mast and are each adapted to be respectively wedged into cusp shaped spaces defined by a wheel tire of a vehicle and the surface on which the vehicle stands, on respectively opposite sides of the area of contact of the tire and the surface.

10. A support structure according to claim 9, wherein the length of the mast is telescopically adjustable.

11. A support structure according to claim 10, wherein at least one of the cantilever and the base is secured to the mast by a demountable coupling.

12. A support structure according to claim 9, wherein at least one of the cantilever and the base is secured by a demountable coupling.

* * * * *